US005877463A

United States Patent [19]

Choi

[11] Patent Number: 5,877,463

[45] Date of Patent: Mar. 2, 1999

[54] SHUTTLE SWITCH ASSEMBLY

[75] Inventor: Sung-Kwan Choi, Seoul, Rep. of Korea

[73] Assignee: Daewood Electronics Co., Ltd., Seoul, Rep. of Korea

[21] Appl. No.: 580,447

[22] Filed: Dec. 27, 1995

[30] Foreign Application Priority Data

Mar. 31, 1995 [KR] Rep. of Korea ..... 95-6241

[51] Int. Cl.[6] ..... H01H 9/00

[52] U.S. Cl. ..... 200/4; 200/5 R

[58] Field of Search ..... 200/1 R, 4, 5 R, 200/6 R, 11 R–11 TC, 16 R, 14, 16 C, 16 D, 17 R, 18, 336, 341, 564, 565, 570

[56] References Cited

U.S. PATENT DOCUMENTS

| | | | |
|---|---|---|---|
| Re. 35,343 | 10/1996 | Shimada et al. | 386/10.3 |
| 4,394,546 | 7/1983 | Harumatsu | 200/5 R |
| 4,857,677 | 8/1989 | Tanaka et al. | 200/5 R |
| 5,369,230 | 11/1994 | Misawa | 200/52 R |
| 5,430,262 | 7/1995 | Matsui et al. | 200/5 A |

FOREIGN PATENT DOCUMENTS

| | | | |
|---|---|---|---|
| 96-5652 | 2/1996 | Rep. of Korea | H01H 19/00 |

*Primary Examiner*—Michael A. Friedhofer

*Attorney, Agent, or Firm*—Beveridge, DeGrandi, Weilacher & Young, LLP

[57] ABSTRACT

A shuttle switch assembly for performing both functions of shuttle and mode is disclosed. The assembly comprises a circuit board. A main base is formed on the circuit board. The main base has a stator protrusively formed at the inner center of the main base and a shuttle axis rotatably formed around the stator. A holder is inserted in the shuttle axis and the holder is provided with a guiding hole having a predetermined length at a side of a periphery of the holder. A dome plate includes a plurality of dome switches on an upper side of the dome plate and the dome plate is installed on the holder; a guiding bracket positioned on an upper portion of the dome plate. The guiding bracket is combined with the holder and is provided with holes which correspond to the dome switches on the dome plate. A shuttle knob is combined with the guiding bracket and is provided with contacting apparatus on a bottom of the shuttle knob. The contacting apparatus is formed correspondingly to the dome switches to press the dome switches on the dome plate after passing the holes of the guiding bracket. Various function modes can be installed and productivity is increased.

11 Claims, 3 Drawing Sheets

SHUTTLE SWITCH ASSEMBLY

BACKGROUND OF THE INVENTION

1. Field of the Invention

The present invention relates to a shuttle switch assembly, and more particularly to a shuttle switch assembly which can perform both of the functions of a shuttle and function knobs.

2. Description of the Prior Art

Generally, a shuttle switch apparatus is applied in a tape recorder, a television or various remote-controlled devices and recently has been widely used because the operation of knob functions thereof is advantageous when compared with the method requiring complicated handling of various knobs.

The shuttle switch apparatus of the tape recorder performs the function of image reproduction in forward or reverse directions at normal, slow or high-speed.

Recently, in addition to the above-mentioned function of the shuttle switch apparatus, function modes such as play, stop and fast forward mode are supplemented to accomplish both of the functions of a shuttle and knob.

FIG. 1 illustrates an example of a shuttle switch assembly supplemented with function knobs as described above.

On a circuit board 110, a main base 120 is fixedly provided and a shuttle axis 130 which is rotatable at a predetermined angle is inserted while applying pressure on a rotatable axis (not shown) on main base 120. At the inner center of shuttle axis 130, two tack switches 140 are protrusively formed on the circuit board 110 to perform the mode function.

At shuttle axis 130, a shuttle ring 150 is inserted while applying pressure in order that a user can hold the shuttle ring to rotate. Function knobs 160 are installed on shuttle ring 150 to perform predetermined mode functions through selectively contacting with tack switches 140 when the user presses the knobs.

Using this shuttle switch assembly, the shuttle function can be accomplished by rotating shuttle ring 150 at a desired direction to a predetermined degree and the desired mode function can be accomplished by pressing function knobs 160 formed in shuttle ring 150.

However, in the above-mentioned shuttle switch assembly, tack switch 140 is expensive and fabrication thereof in shuttle axis 130 is difficult. Moreover, the number of tack switches should be increased to the number of kinds of the desired functions to achieve various functions of more than two. This means that more tack switches should be formed in the narrow space within shuttle axis 130 and the formation thereof is not an easy task. Accordingly, manufacturing shuttle switch assemblies having more various mode functions is difficult.

SUMMARY OF THE INVENTION

An object of the present invention considering the above-described problems is to provide a shuttle switch assembly by which functions of shuttle and various modes can be accomplished, while of which manufacturing cost is reduced and assembling productivity is improved by reducing the constituting elements.

To achieve the object of the present invention, there is provided a shuttle switch assembly comprising: a circuit board for receiving a predetermined signal; a main base formed on the circuit board, the main base having a stator protrusively formed at the inner center of the main base and a shuttle axis rotatably formed around the stator; a holder inserted in the shuttle axis while applying pressure, the holder being provided with a guiding hole having a predetermined length at a side of a periphery of the holder; a dome plate including a plurality of dome switches on an upper side of the dome plate, the dome plate being installed on the holder; a guiding bracket positioned on an upper portion of the dome plate, the guiding bracket being combined with the holder and being provided with holes which correspond to the dome switches on the dome plate; and a shuttle knob combined with the guiding bracket and provided with contacting means on a bottom of the shuttle knob, the contacting means being formed correspondingly to the dome switches to press the dome switches on the dome plate after passing the holes of the guiding bracket.

The holder and the guiding bracket are combined and fixed through a first fixing means. The first fixing means preferably comprises fastening parts protrusively formed at a periphery of the holder, the fastening parts having fastening holes therein; and fastening protrusions protrusively formed at an outer periphery of the guiding bracket in correspondence with the fastening parts, the fastening protrusions being locked with the fastening holes of the fastening parts.

The guiding bracket and the shuttle knob are combined through a second fixing means. The second guiding bracket preferably comprises first hooks formed at a side of a bottom of the shuttle knob and second hooks formed as a side of an upper portion of the guiding bracket, the second hooks being locked with the first hooks.

As for the contacting means, any device which can selectively pressurize corresponding dome switch when a certain function mode is pressurized can be used. A contacting bar is preferred.

At one side of the dome plate, a flexible wire is extendedly formed to transmit signals generated through contact of the contacting means and the dome switches to circuit board.

A plurality of protrusions are formed on the holder and corresponding inserting holes are formed in the dome plate and the guiding bracket to facilitate the assembling of the constituting members of the shuttle switch assembly.

Preferably, partitions are established on the shuttle knob in correspondence with the contacting bars so the user can advantageously handle the intended functions.

The shuttle switch assembly according to the present invention is provided with an apparatus which can perform mode functions within a rotary shuttle switch. Accordingly, both of the shuttle function and various mode functions can be accomplished with a single apparatus. The number of the constituting elements is reduced and simplified to facilitate the manufacture thereof when compared with the conventional shuttle switch assembly. Therefore, the expense is reduced and productivity is increased.

BRIEF DESCRIPTION OF THE DRAWINGS

The above object and other advantages of the present invention will become more apparent by describing in detail preferred embodiments thereof with reference to the attached drawings in which.

DETAILED DESCRIPTION OF THE PREFERRED EMBODIMENT

Hereinafter, the constituting elements of the shuttle switch assembly according to an embodiment of the present invention will be explained in more detail with reference to the accompanying drawings.

Figure 1:
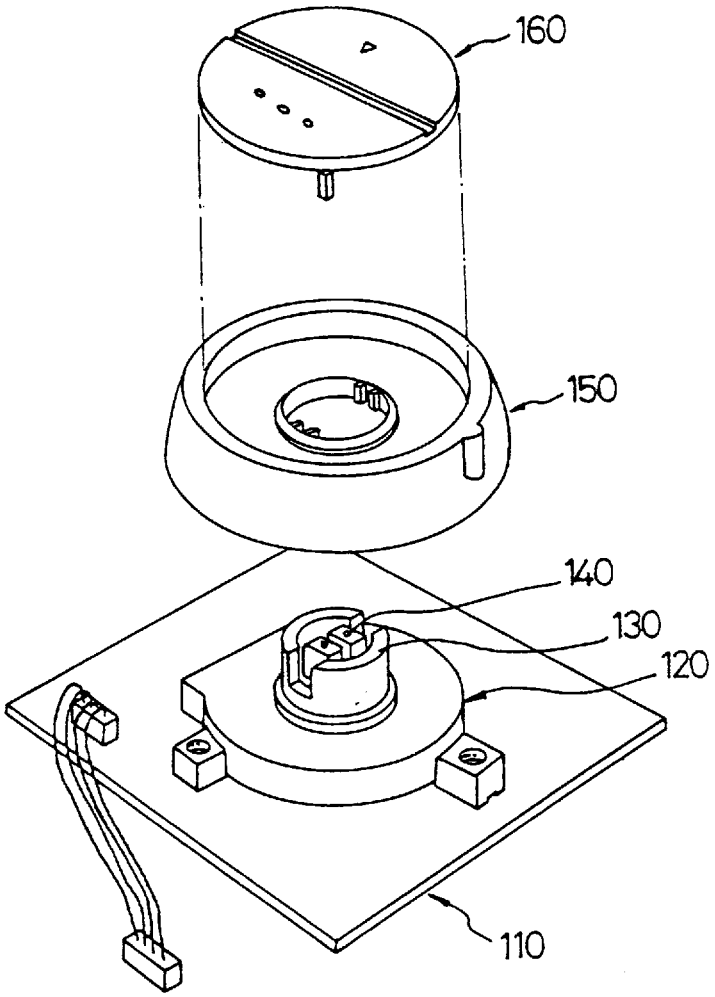
FIG. 1 (PRIOR ART)
FIG. 1 is a schematic perspective view of a shuttle switch assembly according to a conventional embodiment.
Figure 2:
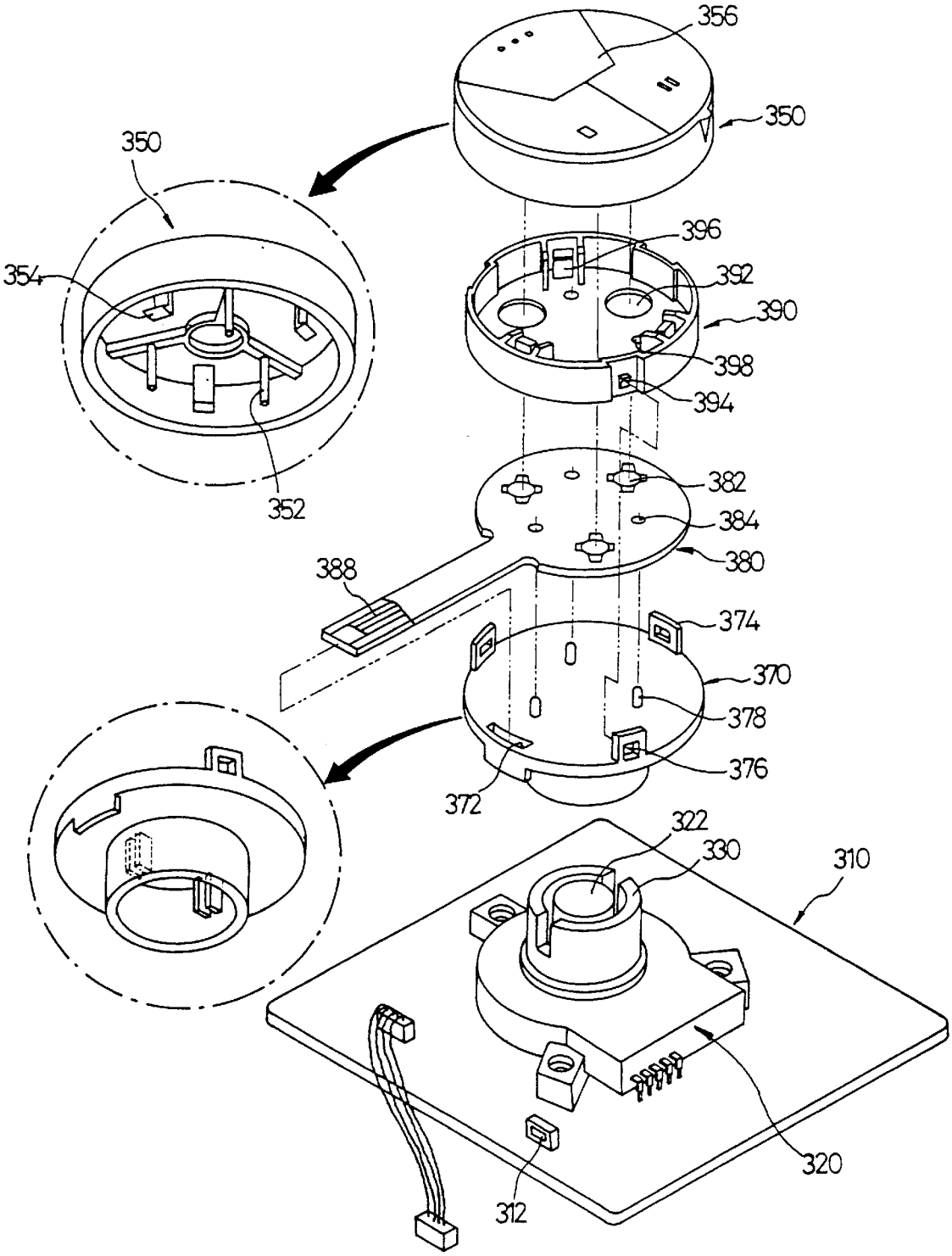
FIG. 2 is an exploded perspective view of a shuttle switch assembly according to an embodiment of the present invention.

FIG. 2 is an exploded perspective view of a shuttle switch assembly according to an embodiment of the present invention.

As shown in FIG. 2, a main base 320 is fixedly installed on the center portion of a circuit board 310 provided with a connector 312. At the center portion of main base 320, a stator 322 is protrusively installed and a shuttle axis 330 is rotatably provided on stator 322. Under shuttle axis 330, a spring for contact, a torsion spring, an inserting member for shuttle, etc. (all not shown) are provided.

A holder 370 is inserted on shuttle axis 330 formed on main base 320, while applying pressure. At the bottom around the periphery of holder 370, a guiding bar 370 having a predetermined length is formed. On holder 370, a dome plate 380 having a plurality of dome switches 382 is seated. At one side of dome plate 380, a flexible wire 388 extendedly formed from each dome switch 382 is provided to pass through guiding hole 372 on holder 370 and to connect with connector 312 on circuit board 310.

In the meantime, a guiding bracket 390 is mounted on dome plate 380, while being combined with holder 370. Guiding bracket 390 and holder 370 are combined through the first fixing device which includes fastening protrusions 394 formed at the side of guiding bracket 390 and fastening holes provided at the periphery of holder 370. At guiding bracket 390, holes 392 are formed at the position corresponding to dome switches 382 on dome plate 380.

The structure of the first fixing device for combining guiding bracket 390 and holder 370 will be described in detail. Fastening parts 374 having fastening holes 376 are extendedly formed at the position where equal angles are kept between fastening parts 374, from the periphery of holder 370 toward guiding bracket 390. And fastening protrusions 392 with which fastening holes 376 of fastening parts 374 are locked, are protrusively formed at the periphery of guiding bracket 390. Through the combination between fastening protrusions 392 and fastening holes 376, holder 370 and guiding bracket 390 are combined without separating from each other.

A shuttle knob 350 is installed on the upper portion of guiding bracket 390, shuttle knob 350 having function knobs formed thereon and a shuttle ring formed at the side of shuttle knob 350 in a body. Contacting bars 352 are protrusively formed on the bottom of shuttle knob 350 for performing function modes by passing through holes 392 of guiding bracket 390 and then pressing dome switches 382 provided on the upper portion of dome plate. The length of contacting bars 352 are adjusted so that dome switches 382 and contacting bars 352 are separated apart at a predetermined distance for maintaining a non-contacting state when the function knobs are not pressed. Guiding bracket 390 and shuttle knob 350 are fixedly combined through the second fixing apparatus. Preferably, on the upper portion of shuttle knob 350, partitions 356 are established at the position corresponding to each contacting bar 352 in order to advantageously press contacting bars 352 to percept the selected function.

The structure of the second fixing apparatus for combining guiding bracket 390 with shuttle knob 350 will be described in detail below. A plurality of first hooks 354 are protrusively formed on the inner bottom of shuttle knob 350 while keeping equal angles between first hooks 354. second hooks 396 are extendedly formed at the inner side of guiding bracket 390 for hooking to first hooks 354 of shuttle knob 350. Through the combination between first hooks 354 and second hooks 396, guiding bracket 390 and shuttle knob 350 could be combined without separating from each other.

On the upper portion of holder 370, a plurality of protrusions 378 are formed and corresponding inserting holes 384 and 398 are formed at dome plate 380 and guiding bracket 390 to combine these elements advantageously when assembling the shuttle switch assembly.

The shuttle switch assembly according to the above-mentioned description was illustrated for the case of installing three contacting bars 352 and corresponding dome switches 382. However, more contacting bars and dome switches can be provided for performing various functions. This can be easily accomplished because the manufacture of the contacting bars on the bottom of the shuttle knob and the manufacture of the dome switches on the upper portion of the flexible dome plate are not difficult.

In addition, the shape of the contacting bars for contact with the dome switches can be changed to any other shape.

Figure 3:
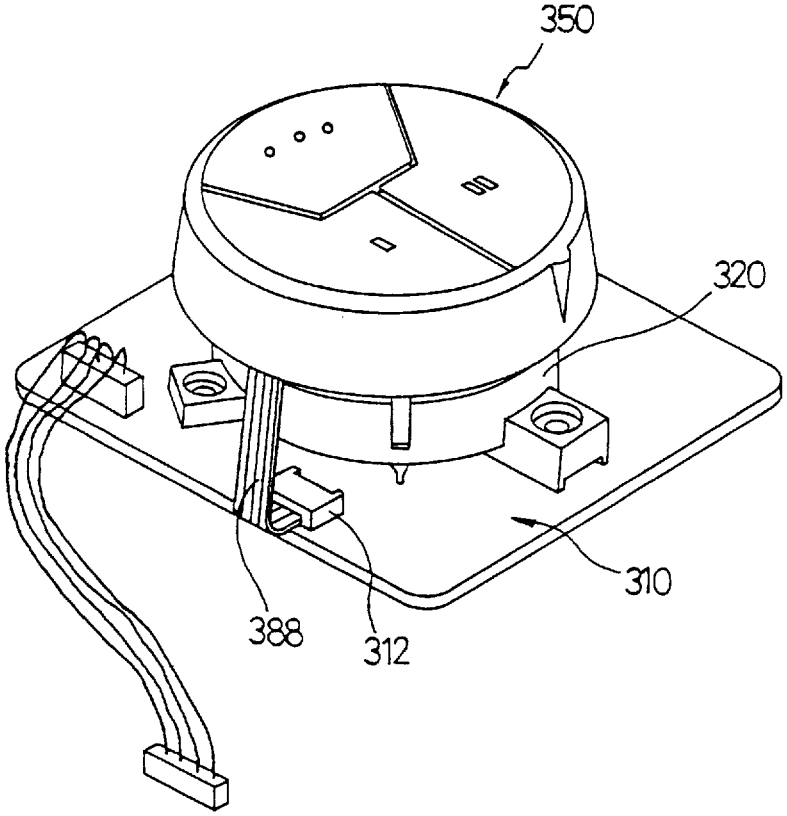
FIG. 3 is an assembled perspective view of a shuttle switch assembly illustrated in FIG. 2.

FIG. 3 is an assembled perspective view of a shuttle switch assembly obtained by combining the above-described elements.

In the shuttle switch assembly constituted as above according to the present invention, when the user rotates shuttle knob 350 to a desired direction of clockwise or counterclockwise according to the function of the shuttle, guiding bracket 390 which is hooked up to shuttle knob 350 along with holder 370 which is fixed with guiding bracket 390 start to rotate. Then, shuttle axis 220 which is installed on stator 322 on main base 320 and to which holder 370 is inserted with pressure, begins to rotate.

If shuttle axis 330 begins to rotate, the spring for contact fixedly formed under shuttle axis 330 contacts with the inserting member for shuttle positioned the spring for contact to generate a predetermined signal, i.e. to perform the shuttle function.

In addition, in the assembly, when a user presses partitions 356 established on shuttle knob 350 according to the mode functions, contacting bars 352 positioned under partitions 356 move downwards to pass holes 392 of guiding bracket 390 to press corresponding dome switches 382 and to generate a predetermined signal. The thus selected function signal is transmitted to circuit board 310 through flexible wire 388 which is extendedly formed at a side of dome plate 380, passes through guiding hole 372 and is connected with connector 312. That is, the selected mode function is carried out.

At last, both of the functions of shuttle and mode can be accomplished through shuttle knob 350.

According to the shuttle switch assembly according to the present invention as described above, both of the functions of shuttle and mode can be performed using the shuttle knob in which the conventional shuttle ring and the function knobs are combined. In addition, the number of elements is reduced and the elements are simplified to increase productivity and reduce manufacturing cost. Accordingly, consumers will be further satisfied with the products such as tape recorders and remote-controlled devices.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A shuttle switch assembly comprising:

a circuit board for receiving a predetermined signal;

a main base formed on said circuit board, said main base having a stator protrusively formed at an inner center of said main base and a shuttle axis rotatably formed around said stator;

a holder inserted in said shuttle axis while applying a pressure, said holder being provided with a guiding hole having a predetermined length at a side of a periphery of said holder;

a dome plate including a plurality of dome switches on an upper side of said dome plate, said dome plate being installed on said holder;

a guiding bracket positioned on an upper portion of said dome plate, said guiding bracket being combined with said holder and being provided with holes which correspond to said dome switches on said dome plate; and a shuttle knob combined with said guiding bracket and provided with contacting means on a bottom of said shuttle knob, said contacting means being formed correspondingly to said dome switches to press said dome switches on said dome plate after passing said holes of said guiding bracket.

2. A shuttle switch assembly as claimed in claim 1, wherein said holder and said guiding bracket are combined and fixed through a first fixing means.

3. A shuttle switch assembly as claimed in claim 2, wherein said first fixing means comprises:

fastening parts protrusively formed at a periphery of said holder, said fastening parts having fastening holes therein; and fastening protrusions protrusively formed at an outer periphery of said guiding bracket in correspondence with said fastening parts, said fastening protrusions being locked with said fastening holes of said fastening parts.

4. A shuttle switch assembly as claimed in claim 1, wherein said guiding bracket and said shuttle knob are combined through a second fixing means.

5. A shuttle switch assembly as claimed in claim 4, wherein said second guiding bracket comprises:

first hooks formed at a side of a bottom of said shuttle knob; and second hooks formed at a side of an upper portion of said guiding bracket, said second hooks being locked with said first hooks.

6. A shuttle switch assembly as claimed in claim 1, wherein said contacting means is a contacting bar.

7. A shuttle switch assembly as claimed in claim 1, wherein a plurality of protrusions are formed on said holder and corresponding inserting holes are formed in said dome plate and said guiding bracket.

8. A shuttle switch assembly as claimed in claim 1, wherein a flexible wire is extendedly formed at a side of said dome plate to transmit signals generated through contact of said contacting means and said dome switches to said circuit board.

9. A shuttle switch assembly as claimed in claim 1, wherein partitions are established on said shuttle knob in correspondence with said contacting bars.

10. A shuttle switch assembly comprising:

a circuit board for receiving a predetermined signal;

a main base formed on said circuit board, said main base having a stator protrusively formed at an inner center of said main base and a shuttle axis rotatably formed around said stator;

a holder inserted in said shuttle axis while applying a pressure, said holder being provided with a guiding hole having a predetermined length at a side of a periphery of said holder;

a dome plate including a plurality of dome switches on an upper side of said dome plate, said dome plate being installed on said holder, a flexible wire is extendedly formed at a side of said dome plate to transmit signals generated through contacting said contacting means and said dome switches to said circuit board;

a guiding bracket positioned on an upper portion of said dome plate, said guiding bracket being combined with said holder through a first fixing means comprising fastening parts protrusively formed at a periphery of said holder, said fastening parts having fastening holes therein; and fastening protrusions protrusively formed at an outer periphery of said guiding bracket in correspondence with said fastening parts, said fastening protrusions being locked with said fastening holes of said fastening parts, said guiding bracket being provided with holes which correspond to said dome switches on said dome plate; and a shuttle knob provided with contacting bars on a bottom of said shuttle knob, said contacting bars being formed correspondingly to said dome switches to press said dome switches on said dome plate after passing said holes of said guiding bracket, wherein said guiding bracket and said shuttle knob are combined through a second fixing means comprising first hooks formed at a side of a bottom of said shuttle knob; and second hooks formed as a side of an upper portion of said guiding bracket, said second hooks being locked with said first hooks.

11. A shuttle switch assembly as claimed in claim 10, wherein the number of said contacting bars and said dome switches corresponding to said contacting bars is at least three.

* * * * *